US010385644B2

(12) United States Patent
Guidry et al.

(10) Patent No.: US 10,385,644 B2
(45) **Date of Patent: *Aug. 20, 2019**

(54) FRACTURING TREES WITH HORIZONTALLY OFFSET CONNECTIONS

(71) Applicant: Cameron International Corporation, Houston, TX (US)

(72) Inventors: Kirk Paul Guidry, Cypress, TX (US); Stefan Marek Radwanski, Houston, TX (US)

(73) Assignee: Camron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/187,002

(22) Filed: Nov. 12, 2018

(65) Prior Publication Data

US 2019/0078412 A1 Mar. 14, 2019

Related U.S. Application Data

(63) Continuation of application No. 15/933,346, filed on Mar. 22, 2018, which is a continuation of application No. 15/257,891, filed on Sep. 6, 2016, which is a continuation of application No. 14/609,078, filed on Jan. 29, 2015, now abandoned, which is a (Continued)

(51) Int. Cl.

| | |
|---|---|
| ***E21B 33/068*** | (2006.01) |
| ***E21B 34/02*** | (2006.01) |
| *E21B 43/26* | (2006.01) |

(52) U.S. Cl.
CPC ..... *E21B 33/068* (2013.01); *E21B 34/02* (2013.01); *E21B 43/26* (2013.01)

(58) Field of Classification Search
CPC ..... E21B 33/068; E21B 34/02
See application file for complete search history.

(56) References Cited

U.S. PATENT DOCUMENTS

| | | | |
|---|---|---|---|
| 4,127,991 | A | 12/1978 | Regan |
| 8,496,062 | B2 | 7/2013 | Kajaria et al. |

(Continued)

FOREIGN PATENT DOCUMENTS

| | | | |
|---|---|---|---|
| CN | 201461291 | U | 5/2010 |
| CN | 201865597 | U | 6/2011 |

(Continued)

*Primary Examiner* — Kristyn A Hall
(74) *Attorney, Agent, or Firm* — Eubanks PLLC

(57) ABSTRACT

A fracturing tree having fracturing fluid connections horizontally offset from a wellhead is provided. In one embodiment a system includes a fracturing tree mounted over a wellhead. The fracturing tree includes a valve to control flow of a fracturing fluid from the fracturing tree to the wellhead. The fracturing tree also includes a set of multiple goathead connections that are horizontally offset from the wellhead such that, when the fracturing fluid is received in the fracturing tree via the set of multiple goathead connections during a fracturing operation, the fracturing fluid entering the fracturing tree through the multiple goathead connections is combined at a location horizontally offset from the wellhead and is subsequently routed laterally through a shared bore toward the wellhead. Additional systems, devices, and methods are also disclosed.

13 Claims, 3 Drawing Sheets

Related U.S. Application Data continuation of application No. 13/204,527, filed on Aug. 5, 2011, now Pat. No. 8,944,159.

(56) References Cited

U.S. PATENT DOCUMENTS

| | | | | |
|---|---|---|---|---|
| 8,944,159 | B2 * | 2/2015 | Guidry | E21B 43/26 166/90.1 |
| 2006/0090891 | A1 | 5/2006 | McGuire et al. | |
| 2006/0237194 | A1 | 10/2006 | Donald et al. | |
| 2008/0083530 | A1 | 4/2008 | Boyd | |
| 2008/0083539 | A1 | 4/2008 | Hickie | |
| 2008/0257540 | A1 | 10/2008 | McGuire et al. | |
| 2009/0090515 | A1 | 4/2009 | Chan et al. | |
| 2009/0145597 | A1 | 6/2009 | Cherewyk | |
| 2011/0259584 | A1 | 10/2011 | Broussard, II | |
| 2012/0152564 | A1 | 6/2012 | Peltier | |
| 2012/0181030 | A1 | 7/2012 | Kajaria et al. | |

FOREIGN PATENT DOCUMENTS

| | | | |
|---|---|---|---|
| CN | 102296945 | A | 12/2011 |
| CN | 202417461 | U | 9/2012 |
| GB | 2184149 | A | 6/1987 |

* cited by examiner

FRACTURING TREES WITH HORIZONTALLY OFFSET CONNECTIONS

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Hydraulic fracturing, commonly referred to as fracing, is a technique used to enhance and increase recovery of oil and natural gas from subterranean natural reservoirs. More specifically, fracing involves injecting a fracing fluid, e.g., a mixture of mostly water and sand, into an oil or gas well at high pressures. The fracing fluid is injected to increase the downhole pressure of the well to a level above the fracture gradient of the subterranean rock formation in which the well is drilled. The high pressure fracing fluid injection causes the subterranean rock formation to crack. Thereafter, the fracing fluid enters the cracks formed in the rock and causes the cracks to propagate and extend further into the rock formation. In this manner, the porosity and permeability of the subterranean rock formation is increased, thereby allowing oil and natural gas to flow more freely to the well.

A variety of equipment is used in the fracing process. For example, fracing fluid blenders, fracing units having high volume and high pressure pumps, fracing tanks, and so forth may be used in a fracing operation. Additionally, a fracing tree is generally coupled between the wellhead of a well and the fracing unit. The fracing tree has a variety of valves to control the flow of fracing fluid and production fluid through the fracing tree.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
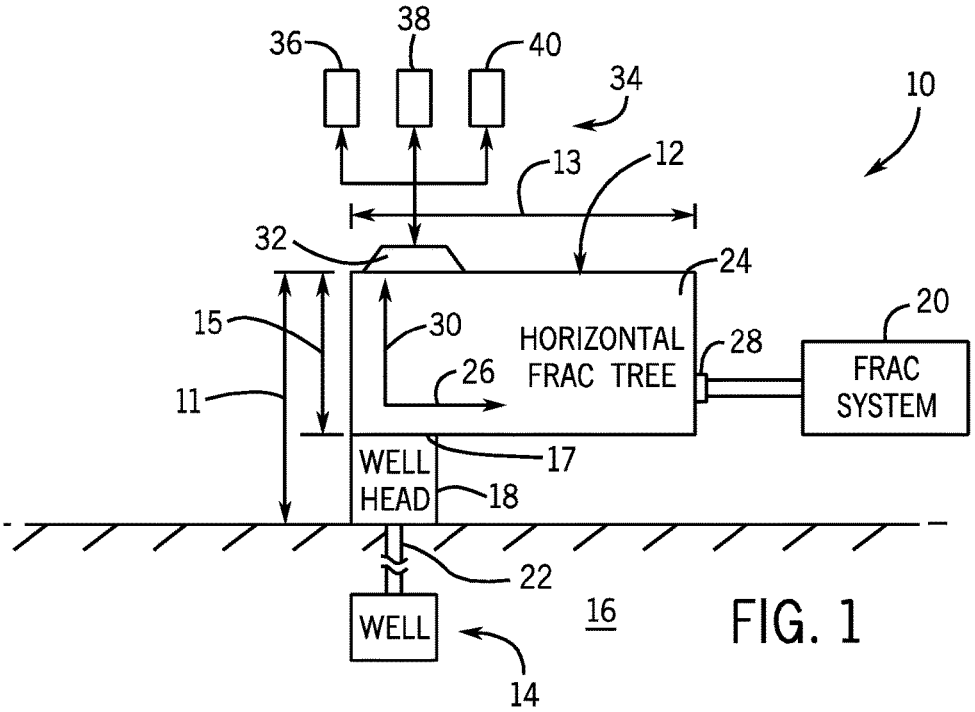
FIG. 1 is a schematic of a horizontal frac tree system coupled to a well head assembly in a surface application.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present disclosure include a frac tree having a horizontal configuration (e.g., a horizontal frac tree), which is configured to reduce the bending moments caused by vibrations, external loads (e.g., connected piping), and so forth. In particular, the horizontal frac tree is specifically designed for a surface application, e.g., land-based in an air environment. Accordingly, the horizontal frac tree may have a variety of mounts, supports, connectors, and other features designed for the surface application. The concepts described herein are not limited to frac trees. In fact, these concepts are also applicable to other flow control devices, such as production trees, workover trees, to name a few.

Hydraulic fracturing, or fracing, involves injecting a fracing fluid into a wellbore to create and propagate cracks in the subterranean rock formation beneath the wellhead. In this manner, the porosity and permeability of the rock formation is increased, leading to enhanced recovery of natural gas and oil from natural reservoirs beneath the earth's surface. The fracing fluid is introduced to the well through a frac tree connected to the wellhead.

As discussed in detail below, the disclosed embodiments provide a frac tree with a horizontal configuration. Specifically, the frac tree may have one or more arms or branches extending horizontally from a master valve of the frac tree. The branches of the frac tree include one or more piping connections (e.g., goathead connections) to enable connection with a fracing system. The horizontal configuration of the frac tree places the frac connections closer to ground level than frac trees with a vertical configuration. As a result, the frac tree may experience reduced external bending moments caused by excessive vibration and other loads experienced during the fracing process.

FIG. 1 is a schematic of a fracing system 10 having a horizontal frac tree 12 (e.g., a surface frac tree). As mentioned above, the fracing system 10 is used to pump a high pressure fracing fluid into a well 14 formed in a subterranean rock formation 16. As will be appreciated, the well 14 may be a natural gas and/or oil well. The horizontal frac tree 12 is coupled to a wellhead 18 of the well 14. As discussed above, a frac system 20 introduces a high pressure fracing fluid into the well 14 through the horizontal frac tree 12 coupled to the well head 18. The frac system 20 may include a variety of high volume and high pressure pumps and monitoring units configured to supply the fracing fluid to the horizontal frac tree 12. In certain embodiments, the fracing fluid may include water. In other embodiments, the fracing fluid may include other components such as chemical gels or foams, as well as gases such as air, nitrogen, and carbon dioxide. As will be appreciated, the particular contents of the fracing fluid may depend on different factors such as the type of rock formation 16, the desired pressure of the fracing fluid, and so forth.

The fracing fluid passes through the horizontal frac tree 12 and the well head 18 into a well bore 22. From the well bore 22, the fracing fluid enters the well 14, and the high pressure of the fracing fluid causes the subterranean rock formation 16 to crack and propagate. As cracks are formed and propagated in the rock formation 16, additional natural gas and/or oil from the rock formation 16 is released and may flow into the well 14 to be recovered.

As shown, the horizontal frac tree 12 has a horizontal branch 24 that extends along a horizontal axis 26 from the well head 18. The horizontal branch 24 includes at least one piping connection (e.g., goathead connection 28, which may itself comprise multiple connections) to couple with the frac system 20. As discussed in detail below, the horizontal branch 24 may include multiple goathead connections 28 in a variety of orientations. Moreover, the goathead connections 28 may include WECO union connectors, compression fit connectors, or other types of pipe connectors for coupling to the frac system 20. In certain embodiments, the goathead connections 28 may have threaded or butt welded ends and may be configured to withstand pressures up to 5,000 psi, 10,000 psi, 15,000 psi, 20,000 psi, 25,000 psi, or more. Furthermore, as discussed below, the horizontal frac tree 12 includes a variety of valves to regulate the flow of the fracing fluid through the horizontal frac tree 12.

As will be appreciated, the horizontal orientation of the horizontal frac tree 12 positions the goathead connections 28 closer to ground level. For example, the disclosed horizontal fracing system 10 has a vertical dimension or height 11 that is substantially less than that of a vertical fracing system, and a horizontal dimension or width 13 that is substantially greater than that of a vertical fracing system. In certain embodiments, the height 11 may be less than approximately 12, 18, 24, 30, 36, 42, or 48 inches. For example, the height 11 may be approximately 12 to 60, 18 to 48, or 24 to 36 inches. Furthermore, the width 13 may be approximately 1 to 20, 2 to 15, or 3 to 10 feet. In certain embodiments, a width/height ratio of the width 13 to the height 11 may be approximately 2:1 to 20:1, 3:1 to 15:1, or 4:1 to 10:1. By further example, the horizontal frac tree 12 (i.e., above the wellhead 18) may have a vertical dimension or height 15 that is substantially less than a vertical frac tree, and the horizontal dimension or width 13 that is substantially greater than a vertical frac tree. In certain embodiments, the height 15 may be less than approximately 12, 18, 24, 30, 36, 42, or 48 inches. For example, the height 15 may be approximately 12 to 48, 18 to 42, or 24 to 36 inches. Furthermore, the width 13 may be approximately 1 to 20, 2 to 15, or 3 to 10 feet. In certain embodiments, a width/height ratio of the width 13 to the height 15 may be approximately 2:1 to 20:1, 3:1 to 15:1, or 4:1 to 10:1.

As mentioned above, a frac tree may be subjected to vibrations and other forces that create a bending moment in the frac tree 12. The horizontal frac tree 12 reduces the possibility of bending moments exceeding specified parameters at a connection 17 (e.g., a flanged connection) between the well head 18 and the horizontal frac tree 12 by positioning external loads (e.g., piping, valves, and other components) closer to the ground level. In other words, the external loads are vertically closer to the connection 17, thereby substantially reducing any bending moment relative to the connection 17. Specifically, the bending moment about a vertical axis 30 of the well 14 may be reduced with the illustrated horizontal frac tree 12. Furthermore, the horizontal frac tree 12 may have a variety of mounts, connections, and supports to help retain the horizontal branch 24 in the horizontal orientation without subjecting the connection 17 to bending. The horizontal frac tree 12 also improves serviceability, because a technician can more easily inspect and repair the tree 12 at the ground level. As a result, operators of the fracing system 10 may not need an external lifting or raising apparatus (e.g., a ladder, hydraulic lift, or scaffolding) to reach the goathead connections 28. Indeed, all components and connections of the horizontal frac tree 12 may be accessed from the ground level.

In addition to the goathead connections 28 that may be used for the fracing process, the horizontal frac tree 12 also includes a vertical access connection 32. Consequently, a well operator may have separate access to the well 14, while the frac system 20 is coupled to the horizontal frac tree 12. As shown, the vertical access connection 32 is generally in line with the vertical axis 30 of the well 14. The vertical access connection 32 may be used to access the well 14 in a variety of circumstances. For example, the vertical access connection 32 may be used for natural gas and/or oil recovery, fracing fluid recovery, insertion of a frac mandrel, and so forth. During the fracing process, the vertical access connection 32 may not be in use. In such circumstances, the vertical access connection 32 may be plugged or sealed in order to maintain a high pressure in the well 14. More specifically, the vertical access connection 32 may be plugged with one or more of a variety of plugs 34, such as metal or elastomer seals. For example, a one-way back pressure valve (BPV) plug 36 or a wireline set plug 38 may be used to plug the vertical access connection 32. In certain embodiments, a lubricator 40 may be used to seal the vertical access connection 32. As will be appreciated, one or more plugs 34 may be used in the vertical access connection 32 to isolate the well 14 and the wellbore 22. Additionally, as discussed below, one or more plugs 34 may be used below a horizontal bore (72; see FIG. 2) in the horizontal frac tree 12 to isolate any equipment coupled the vertical access connection 32 above the horizontal frac tree 12. The vertical access connection 32 also may be used to insert a variety of tools and other equipment into the wellbore 22.

Figure 2:
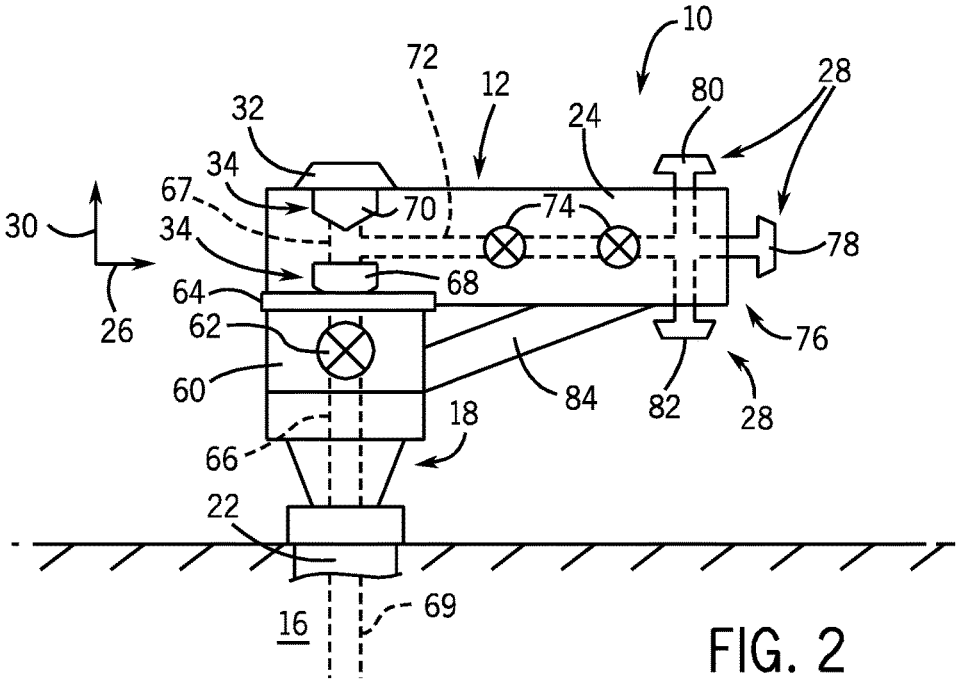
FIG. 2 is an embodiment of a horizontal frac tree system having a single horizontal branch.

FIG. 2 is a schematic of an embodiment of the fracing system 10, illustrating the horizontal frac tree 12 having one branch 24 with three goathead connections 28. In the illustrated embodiment, the horizontal frac tree 12 is coupled to a master valve block 60 having a master valve 62. More specifically, in this embodiment, the horizontal frac tree 12 is coupled to the master valve block 60 by a flange 64. In other embodiments, as discussed below, the master valve block 60 and the horizontal frac tree 12 may be part of a single unified block or may be coupled through a union nut assembly that draws the two components together. As will be appreciated, the master valve 62 regulates the flow through a main bore 66 coupled to the wellbore 22. The flow through the main bore 66 may be a production fluid such as natural gas and/or oil or a fracing fluid supplied by the frac system 20. The main bore 66 and a vertical bore 67 of the tree 12 may be sized to provide "full bore access", such that tools may be inserted through the main and vertical bores 66 and 67 into the wellbore 22, without restrictions from the main and vertical bores 66 and 67. This can be accomplished by, for example, ensuring the main and vertical bores 66 and 67 have an internal diameter that is equal to or greater than the internal diameter of a production casing 69 within the wellbore 22. In certain embodiments, the master valve 62 may be manually operated. In other embodiments, the master valve 62 may be hydraulically operated. Additionally, plugs 34 may be disposed in the main bore 66 to isolate a desired portion of the bore 66. For example, a plug 68 may be disposed in the main bore 66 to isolate a flow of fracing fluid to the well bore 22. Similarly, a plug 70 may be disposed in the main bore 66 to isolate equipment coupled to the vertical access connection 32. Moreover, because the illustrated embodiment includes only one master valve 62, a well operator may access the well bore 22 through the vertical access connection 32 without needing to go through multiple valves.

As shown, a horizontal bore 72 extends through the horizontal frac tree 12 along the horizontal axis 26 of the frac tree 12 (e.g., along horizontal branch 24), and is operatively connected to the main bore 66. The horizontal frac tree 12 also includes valves 74 disposed along the horizontal bore 72. The valves 74 are configured to control and regulate the flow of fracing fluid from the fracing system to the main bore 66 and the well bore 22. As with the master valve 62, the valves 74 of the horizontal frac tree 12 may be manually or hydraulically operated. The horizontal frac tree 12 also includes three goathead connections 28 at an end 76 of the branch 24 opposite the main bore 66. More specifically, the frac tree 12 includes a horizontal goathead connection 78, a top vertical goathead connection 80, and a bottom vertical goathead connection 82. While the illustrated embodiment includes three goathead connections 38, other embodiments may include 1, 2, 4, 5, 6, or more goathead connections 28 or other types of piping connections. Each goathead connection 28 is operatively connected to the horizontal bore 72. As will be appreciated, each of the three goathead connections 28 may be connected to the frac system 20 by a pipe or other conduit configured to flow a fracing fluid. Furthermore, in the illustrated embodiment, the horizontal frac tree 12 is supported by a brace 84 extending from the frac tree 12 to the master valve block 60. For example, the brace 84 may be mechanically coupled (e.g., bolted) or welded between the frac tree 12 and the block 60. In other embodiments, as discussed below, the horizontal frac tree 12 may be supported by a post or brace mounted to a skid. The brace 84 helps to retain the horizontal branch 24 in the horizontal orientation, thereby reducing the possibility of any bending or pivoting of the horizontal branch 24 relative to the block 60, well head 18, or various connections (e.g., flange 64).

Figure 3:
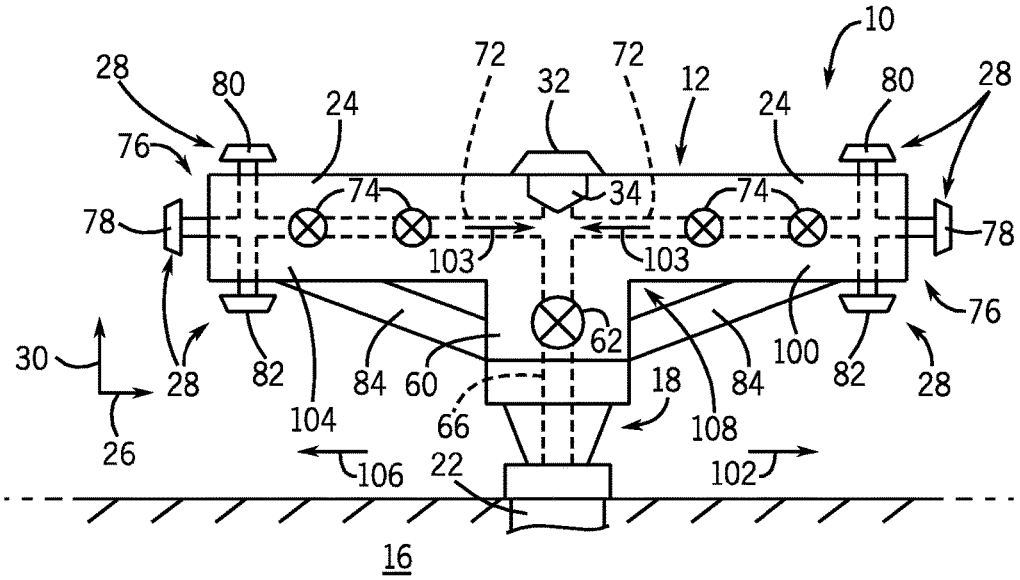
FIG. 3 is an embodiment of a horizontal frac tree system having a unified block configuration and two horizontal branches.

FIG. 3 is a schematic of an embodiment of the fracing system 10, illustrating the horizontal frac tree 12 having two horizontal branches 24. The illustrated embodiment includes similar elements and element numbers as the embodiment shown in FIG. 2. Both horizontal branches 24 extend from the main bore 66 along the horizontal axis 26. Additionally, the horizontal branches 24 of the frac tree 12 extend in opposite horizontal directions. In other words, a first branch 100 extends in a first direction 102 horizontally away from the well head 18, a second branch 104 extends in a second direction 106 horizontally away from the well head 18, and the first and second directions 102 and 106 are approximately 180 degrees apart. In other embodiments, the first and second directions 102 and 106 may be 1 to 179, 2 to 150, 3 to 100, 4 to 50, or 5 to 25 degrees apart. Similarly, other embodiments of the horizontal frac tree 12 may include three or more horizontal branches 24. For example, the branches 24 of the horizontal frac tree 12 may be configured in a symmetrical arrangement (e.g., two branches 24 at 180 degrees apart, three branches 24 at 120 degrees apart, four branches at 90 degrees apart, five branches 24 at 72 degrees apart, or six branches 24 at 60 degrees apart) about the well head 18, thereby reducing the possibility of any bending or pivoting relative to the well head 18, block 60, and associated connections (e.g., flange 64). The symmetrical arrangement of branches 24 may include substantially equal lengths, diameters, and/or weights to help distribute the loads symmetrically about the well head 18. In other embodiments, the branches 24 may not be in a symmetrical arrangement about the well head 18.

As shown, the horizontal bore 72 of each of the first and second branches 100 and 104 of the horizontal frac tree 12 is operatively connected to the main bore 66. As a result, two flows of fracing fluid may enter the main bore 66 during a fracing operation, as indicated by arrows 103. Additionally, both horizontal branches 100 and 104 have three goathead connections 28, wherein each goathead connection 28 is operatively connected to the respective horizontal bore 72 of the first and second branches 100 and 104. As discussed above, the horizontal branches 24 may have other numbers of goathead connections 28, such as 1, 2, 4, 5, 6, or more goathead connections 28.

In the illustrated embodiment, the first and second horizontal branches 100 and 104 and the master valve block 60 form a single, continuous block 108. In other words, the first and second horizontal branches 100 and 104 and the master valve block 60 may be a single piece, and are not coupled to one another by the flange 64. For example, a single block of metal may be used to form the branches 100 and 104 and the block 60, rather than connecting separate metal components together. In other embodiments, the first and second horizontal branches 100 and 104 and the master valve block 60 may be fixedly coupled together via welded joints or other permanent connections. In this manner, the number of flanges 64 and other removable connections in the fracing system 10 is reduced, thereby increasing the structural integrity in the fracing system 10 and reducing the effects of bending moments on the fracing system 10.

Figure 4:
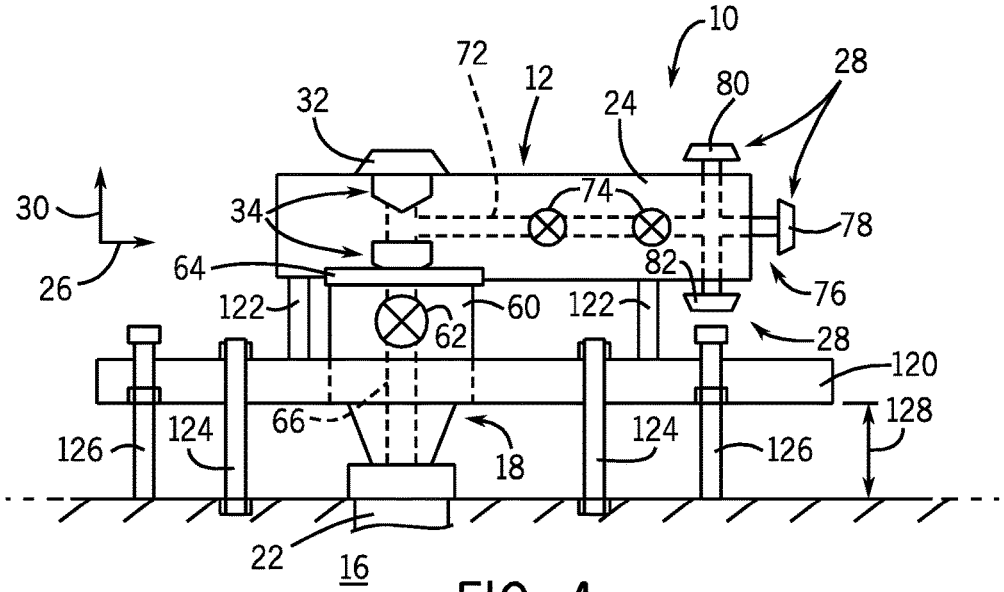
FIG. 4 is an embodiment of a horizontal frac tree system mounted to a skid.

FIG. 4 is a schematic of an embodiment of the fracing system 10, illustrating the horizontal frac tree 12 mounted to a skid 120. The illustrated embodiment includes similar elements and element numbers as the embodiment shown in FIG. 2. As shown, the skid 120 is disposed about the wellhead 18 and supports the horizontal frac tree 12. In certain embodiments, the skid 120 may include a central opening that is completely surrounded by structural elements (e.g. beams and framework), such that the well head 18 fits in the central opening and is completely surrounded by the structural elements. Accordingly, the horizontal frac tree 12 may be installed by moving the skid 120 to a position above the well head 18, and then gradually lowering the skid 120 downward such that the well head 18 fits within the central opening. In other embodiments, the skid 120 may include an opening or slot that extends horizontally from an edge of the skid 120 to a central portion of the skid 120. Accordingly, the horizontal frac tree 12 may be installed by moving the skid 120 horizontally toward the well head 18, such that the well head gradually moves along the slot until the tree 12 is in the proper position. In either embodiment, the skid 120 helps to support, level, and generally align the tree 12 during and after the installation of the tree 12. In addition, the horizontal frac tree 12 is supported by braces 122, which extend between the horizontal frac tree 12 and the skid 120. In certain embodiments, the braces 122 may be mechanically secured (e.g., bolted) or welded between the horizontal frac tree 12 and the skid 120. The skid 120 is secured to the ground by anchored posts 124. For example, the anchored posts 124 may be secured to the ground by concrete or other anchoring material.

Additionally, the skid 120 includes adjustment legs 126. The adjustment legs 126 enable height adjustability of a height 128 of the skid 120 from the ground. For example, the adjustment legs 126 may be pneumatically-driven legs, hydraulically-driven legs, motorized legs, threaded legs, or any combination thereof. Furthermore, the adjustment legs 126 may be manually adjusted by an operator, or the adjustment legs 126 may be automatically adjusted by a controller that incorporates sensor feedback, user input, and various models (e.g., a CAD model of the tree 12, a model of the landscape, and so forth.

As the height 128 of the skid 120 is adjusted, the height of the horizontal frac tree 12 is adjusted. The adjustment legs 126 may be used to provide additional vertical support to hold the horizontal frac tree 12 in place, thereby blocking any undesired movement of the tree 12. The adjustment legs 126 also may be used to level the tree 12 relative to the ground and/or align the tree 12 relative to the well head 18. For example, the rightward adjustment leg(s) 126 may be used to raise or lower the right portion of the skid 120, and thus the horizontal frac tree 12. Likewise, the leftward adjustment leg(s) 126 may be used to raise or lower the left portion of the skid 120, and thus the horizontal frac tree 12.

Figure 5:
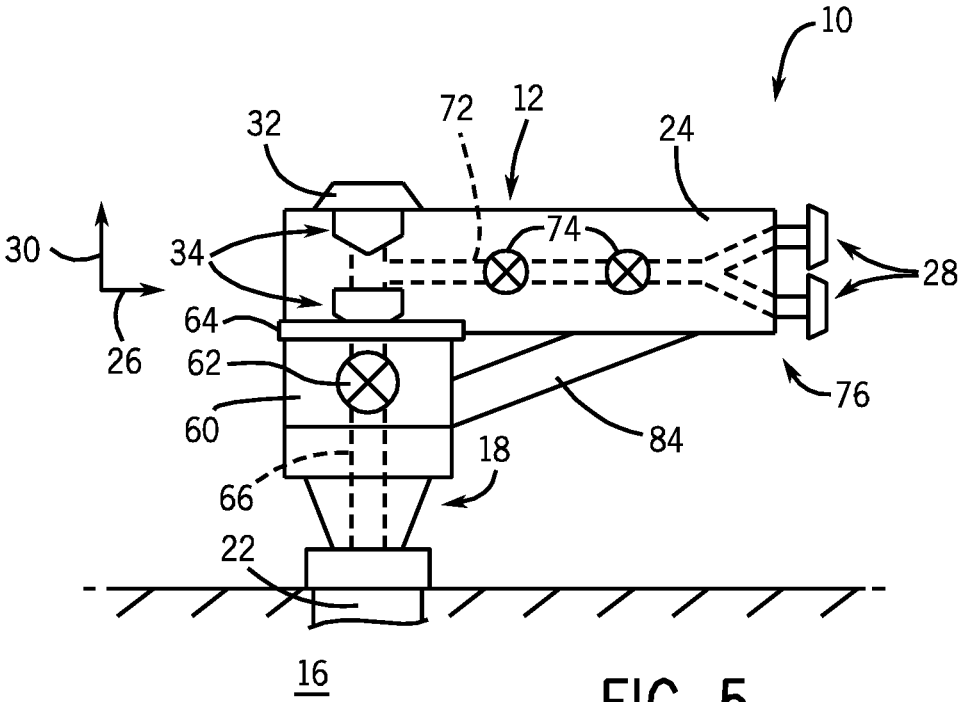
FIG. 5 is an embodiment of a horizontal frac tree system having two horizontal goathead connections.

FIG. 5 is a schematic of an embodiment of the fracing system 10, illustrating a horizontal frac tree 12 having two horizontal goathead connections 28. The illustrated embodiment includes similar elements and element numbers as the embodiment shown in FIG. 2. As shown, the end 76 of the branch 24 of the frac tree 12 includes two goathead connections 28. More specifically, each goathead connection 28 extends horizontally from the end 76 of the branch 24. In other words, each of the goathead connections 28 extends from the end 76 along the horizontal axis 26 of the horizontal frac tree 12. As discussed above, each goathead connection 28 is operatively connected to the horizontal bore 72.

Figure 6:
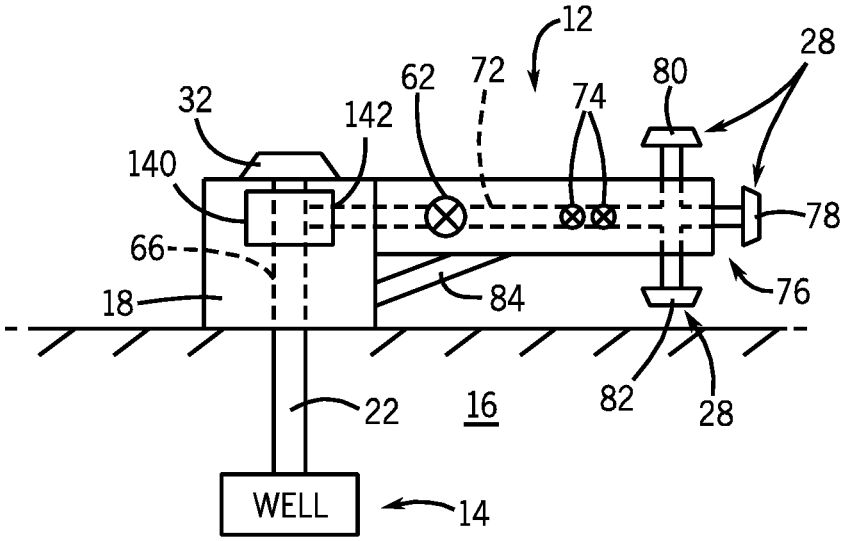
FIG. 6 is an embodiment of a horizontal frac tree system having a casing hangar with an access port for a horizontal bore.

FIG. 6 is an embodiment of the fracing system 10, illustrating the wellhead 18 having a casing hanger 140 with an access port 142 for the horizontal bore 72. The illustrated embodiment includes similar elements and element numbers as the embodiment shown in FIG. 2. As shown, the horizontal bore 72 extends through the access port 142 of the casing hanger 140 and is coupled to the main bore 66. Additionally, in the illustrated embodiment, the master valve 62 is located on the horizontal frac tree 12 and along the horizontal bore 72. As will be appreciated, the connection of the horizontal bore 72 to the main bore 66 through the access port 142 of the casing hanger 140 enables an operator to access the casing hanger 140 (e.g., through the vertical access 32) without needing to move the horizontal frac tree 12. Similarly, an operator may access the main bore 66 and the wellbore 22 without removing the horizontal frac tree 12 from the wellhead 18.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a wellhead; and a fracturing tree mounted over the wellhead, the fracturing tree including a valve to control flow of a fracturing fluid from the fracturing tree to the wellhead, the fracturing tree also including a set of multiple goathead connections that are horizontally offset from the wellhead such that, when the fracturing fluid is received in the fracturing tree via the set of multiple goathead connections during a fracturing operation, the fracturing fluid entering the fracturing tree through the multiple goathead connections is combined at a location horizontally offset from the wellhead after the fracturing fluid has flowed through the multiple goathead connections and is subsequently routed laterally through a shared bore toward the wellhead.

2. The system of claim 1, wherein the valve includes at least one valve positioned along the shared bore.

3. The system of claim 1, wherein the shared bore includes a horizontal bore.

4. The system of claim 3, wherein the valve is positioned along the horizontal bore.

5. The system of claim 3, wherein the shared bore includes a vertical bore that extends downwardly toward the wellhead and is in fluid communication with the horizontal bore.

6. The system of claim 5, comprising an additional valve that is positioned along the vertical bore.

7. The system of claim 6, wherein:

the valve is positioned along the horizontal bore; and the valve positioned along the horizontal bore, the additional valve positioned along the vertical bore, and a junction of the horizontal and vertical bores are located together in a single block of metal.

8. The system of claim 1, wherein the valve includes a master valve mounted over the wellhead.

9. The system of claim 1, comprising a brace that supports a portion of the fracturing tree that is horizontally offset from the wellhead.

10. The system of claim 1, wherein the fracturing tree includes a vertical access connection that is vertically aligned with the wellhead.

11. A method comprising:

receiving a fracturing fluid into a fracturing tree through multiple goathead connections, wherein the fracturing tree is coupled to a wellhead;

combining, after the fracturing fluid has flowed through the multiple goathead connections, the fracturing fluid received through individual goathead connections of the multiple goathead connections at a location that is horizontally offset from the wellhead rather than being directly above the wellhead; and routing the combined fracturing fluid into the wellhead from the location at which the fracturing fluid is combined.

12. The method of claim 11, wherein routing the combined fracturing fluid into the wellhead from the location at which the fracturing fluid is combined includes routing the combined fracturing fluid through a horizontal bore.

13. The method of claim 12, wherein combining the fracturing fluid received through the individual goathead connections of the multiple goathead connections at the location that is horizontally offset from the wellhead rather than being directly above the wellhead includes combining the fracturing fluid received through the individual goathead connections of the multiple goathead connections at a location within the horizontal bore.

* * * * *